US009004195B2

(12) United States Patent
Regener et al.

(10) Patent No.: US 9,004,195 B2
(45) Date of Patent: Apr. 14, 2015

(54) APPARATUS AND METHOD FOR DRILLING A WELLBORE, SETTING A LINER AND CEMENTING THE WELLBORE DURING A SINGLE TRIP

(75) Inventors: Thorsten Regener, Niedersachsen (DE); Ingo Roders, Seelze (DE); Carl C. Clemmensen, Bergen (NO); Sascha Schwartze, Sandnes (NO); Trond R. Skar, Sandnes (NO); Tore Sorheim, Tananger (NO); Morten Eidem, Trondheim (NO); Gaute Grindhaug, Hafrsfjord (NO)

(73) Assignee: Baker Hughes Incorporated, Houston, TX (US)

( * ) Notice: Subject to any disclaimer, the term of this patent is extended or adjusted under 35 U.S.C. 154(b) by 304 days.

(21) Appl. No.: 13/591,646

(22) Filed: Aug. 22, 2012

(65) Prior Publication Data

US 2014/0054036 A1 Feb. 27, 2014

(51) Int. Cl.

| | |
|---|---|
| ***E21B 7/20*** | (2006.01) |
| ***E21B 23/02*** | (2006.01) |
| ***E21B 7/28*** | (2006.01) |
| ***E21B 33/14*** | (2006.01) |
| ***E21B 43/10*** | (2006.01) |

(52) U.S. Cl.

CPC . *E21B 43/10* (2013.01); *E21B 7/28* (2013.01); *E21B 33/14* (2013.01)

(58) Field of Classification Search

USPC ..... 166/285, 382, 177.4, 208; 175/171, 175/385, 65, 57

See application file for complete search history.

(56) References Cited

U.S. PATENT DOCUMENTS

| | | | | |
|---|---|---|---|---|
| 4,869,323 | A | 9/1989 | Stagg | |
| 5,074,366 | A | 12/1991 | Karlsson et al. | |
| 5,148,875 | A | 9/1992 | Karlsson et al. | |
| 5,425,423 | A * | 6/1995 | Dobson et al. | 166/278 |
| 5,531,273 | A * | 7/1996 | Dobson et al. | 166/278 |
| 6,848,517 | B2 | 2/2005 | Wardley | |
| 7,108,080 | B2 * | 9/2006 | Tessari et al. | 175/21 |
| 7,234,546 | B2 | 6/2007 | Vincent et al. | |
| 7,334,650 | B2 | 2/2008 | Giroux et al. | |
| 7,647,990 | B2 | 1/2010 | Tessari et al. | |
| 7,784,552 | B2 | 8/2010 | Brouse | |
| 7,823,660 | B2 | 11/2010 | Giroux et al. | |
| 7,857,052 | B2 | 12/2010 | Giroux et al. | |
| 7,926,578 | B2 * | 4/2011 | Moffitt et al. | 166/380 |
| 7,926,590 | B2 * | 4/2011 | Eriksen et al. | 175/57 |
| 8,733,474 | B2 * | 5/2014 | Nikiforuk | 175/57 |
| 2008/0135289 | A1 | 6/2008 | Ford | |
| 2009/0090508 | A1 * | 4/2009 | Brouse | 166/289 |
| 2009/0101345 | A1 * | 4/2009 | Moffitt et al. | 166/285 |
| 2009/0107675 | A1 | 4/2009 | Eriksen et al. | |

(Continued)

OTHER PUBLICATIONS

International Search Report and Written Opinion dated Jan. 22, 2014 for International Application No. PCT/US2013/056110; all references in PCT are cited above.

*Primary Examiner* — Jennifer H Gay

(74) *Attorney, Agent, or Firm* — Cantor Colburn LLP

(57) ABSTRACT

A method of forming a wellbore is disclosed. An inner string and an outer string are conveyed downhole. The inner string is attached to the outer string at a first location and the wellbore is formed. The inner stringy is attached to the outer string at a second location us hole of the first location and an annulus between the outer string and the wellbore is cemented without retrieving the inner string from the wellbore.

26 Claims, 5 Drawing Sheets

(56) References Cited

U.S. PATENT DOCUMENTS

2011/0061939 A1 3/2011 Boyle
2011/0203794 A1* 8/2011 Moffitt et al. ..... 166/285
2012/0181044 A1* 7/2012 Nikiforuk ..... 166/374
2012/0222861 A1* 9/2012 Eriksen ..... 166/290
2014/0034311 A1* 2/2014 Lirette et al. ..... 166/285
2014/0041881 A1* 2/2014 Dirksen et al. ..... 166/382

* cited by examiner

APPARATUS AND METHOD FOR DRILLING A WELLBORE, SETTING A LINER AND CEMENTING THE WELLBORE DURING A SINGLE TRIP

BACKGROUND OF THE DISCLOSURE

1. Field of the Disclosure

The present disclosure relates to apparatus and methods for drilling a wellbore, lining the wellbore and cementing the wellbore during a single trip of a drill string downhole.

2. Background Art

Wellbores are drilled in earth formations using a drill string to produce hydrocarbons (oil and gas) from underground reservoirs. The wells are generally completed by placing a casing (also referred to herein as a "liner" or "tubular") in the wellbore. The spacing between the liner and the wellbore inside, referred to as the "annulus," is then filled with cement. The liner and the cement may be perforated to allow the hydrocarbons to flow from the reservoirs to the surface via a production string installed inside the liner. Some wells are drilled with drill strings that include an outer string that is made with the liner and an inner string that includes a drill bit (called a "pilot bit"), a bottomhole assembly and a steering device. The inner string is placed inside the outer string and securely attached therein at a suitable location. The pilot bit, bottomhole assembly and steering device extend past the liner to drill a deviated well. The pilot bit drills a pilot hole that is enlarged by a reamer bit attached to the bottom end of the liner. The liner is then anchored to the wellbore. The inner string is pulled out of the wellbore and the annulus between the wellbore and the liner is then cemented.

The disclosure herein provides a drill string and methods for using the same to drill a wellbore and cement the wellbore during a single trip.

SUMMARY OF THE DISCLOSURE

In one aspect, the disclosure provides a method of forming a wellbore that in one embodiment includes: providing a drill string that includes an inner string having a pilot bit and an under reamer and an outer string that includes a liner and a reamer bit at an end of the liner; drilling a borehole with the pilot bit to a first size followed by the under reamer to at least the size of the outer string; retracting the pilot bit inside the outer string; enlarging a remaining section of the pilot hole with the reamer bit to form the wellbore; cementing an annulus between the liner and the wellbore borehole during a single trip of the drill string in the wellbore.

In another aspect, an apparatus for forming a wellbore is provided that in one embodiment includes an outer string having a liner and a reamer bit at an end thereof and an inner string having a pilot bit and an under reamer configured to pass through the outer string, wherein the inner string is configured to attach to the outer string at first location for the pilot bit to drill a hole of a first size and the under reamer to enlarge the pilot hole to at least the size of the outer string; and attach to a second location to enable the reamer bit to enlarge the a remaining section of the hole of the first size to a hole of a second size to form the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

DESCRIPTION OF THE DRAWINGS

For detailed understanding of the present disclosure, references should be made to the following detailed description, taken in conjunction with the accompanying drawings, in which like elements have been given like numerals and wherein.

DESCRIPTION OF THE DISCLOSURE

In general, the disclosure provides apparatus and methods for drilling a wellbore, setting a liner in the drilled wellbore and cementing the annulus between the liner and the wellbore in a single trip. In aspects, the apparatus may include an inner string that may be connected to an outer string having a liner (also referred to as the "liner string") at different spaced apart locations. In aspects, the apparatus may be deployed to drill a wellbore, install or hang a liner in the wellbore and cement the wellbore during a single trip downhole. In other aspects, the apparatus may be utilized to drill a pilot hole, enlarge the pilot hole, ream the enlarged hole to a desired size and cement the wellbore during a single trip downhole. In other aspects, the inner string may be connected to and released from the outer string using command signals sent from a surface location.

Figure 1:
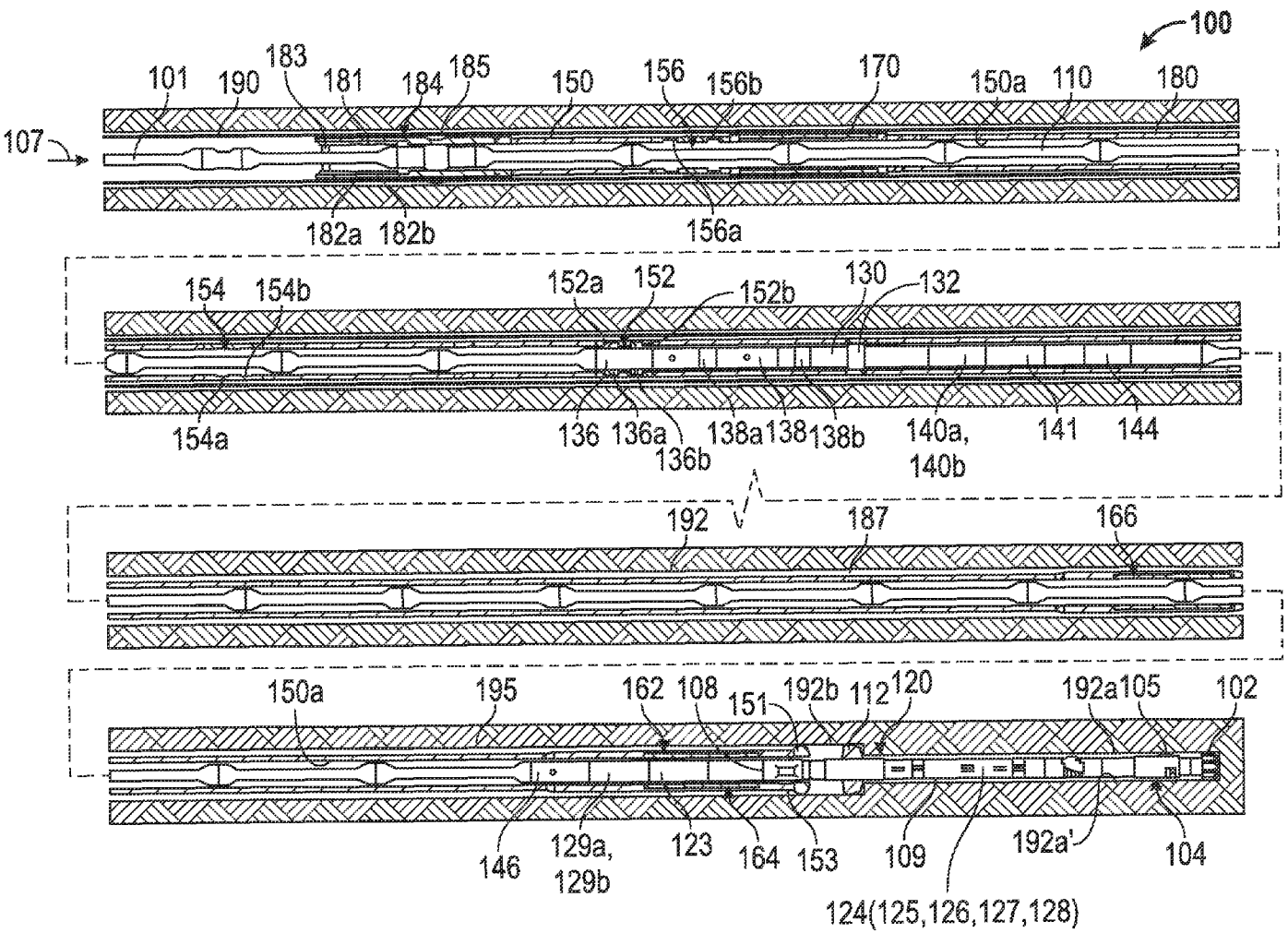
FIG. 1 is a line diagram of an exemplary drill string that includes an inner string and an outer string, wherein the inner string is connected to a first location of the outer string to drill a hole of a first size.

FIG. 1 is a line diagram of an exemplary string 100 that includes an exemplary inner string 110 disposed in an exemplary outer string 150. In this embodiment, the inner string 110 is adapted to pass through the outer string 150 and connect to the inside 150*a* of the outer string 150 at a number of spaced apart locations (also referred to herein as the "landings" or "landing locations"). The shown embodiment of the outer string 150 includes three landings, namely a lower landing 152, a middle landing 154 and an upper landing 156. The inner string 110 includes a drilling assembly 120 (also referred to as the "bottomhole assembly") connected to a bottom end of a tubular member 101, such as a string of jointed pipes or a coiled tubing. The drilling assembly 120 has a drill bit 102 (also referred to herein as the "pilot bit") at its bottom end for drilling a borehole of a first size 192*a* (also referred to herein as the "pilot hole"). The drilling assembly 120 further includes a steering device 104 that in one embodiment may include a number of force application members 105 configured to extend from the drilling assembly 120 to apply force on wall 192*a*' of the pilot hole 192*a* drilled by the pilot bit 102 to steer the pilot bit 102 along a selected direction, such as to drill a deviated pilot hole. The drilling assembly 120 may also include a drilling motor (also referred to as the "mud motor") 108 configured to rotate the pilot bit 102 when a fluid 107 under pressure is supplied to the inner string 110. In the particular configuration of FIG. 1, the drilling assembly 120 is also shown to include an under reamer 112 that may be extended from and retracted toward the drilling assembly body, as desired, to enlarge the pilot hole 192*a* to form the wellbore 192*b*, to at least the size of the outer string. In aspects, the drilling assembly 120 includes a number of sensors (collectively designated by numeral 109) for providing signals relating to a number of downhole parameters, including, but not limited to, various properties or characteristics of the formation 195 and parameters relating to the operation of the string 100. The drilling assembly 120 also includes a control circuit (also referred to as a "controller") 124 that may include circuits 125 to condition the signals from the various sensors 109, a processor 126, such as a microprocessor, a data storage device 127, such as a solid-state memory and programs 128 accessible to the processor 126 for executing instructions contained in the programs 128. The controller 124 communicates with a surface controller (not shown) via a suitable telemetry device 129*a* that provides two-way communication between the inner string 110 and the surface controller. The telemetry unit 129*a* may utilize any suitable data communication technique, including, but not limited to, mud pulse telemetry, acoustic telemetry, electromagnetic telemetry, and wired pipe. A power generation unit 129*b* in the inner string 110 provides electrical power to the various components in the inner string 110, including the sensors 109 and other components in the drilling assembly 120. The drilling assembly also may include a second power generation device 123 capable of providing electrical power independent from the presence of the power generated using the drilling fluid 107.

In aspects, the inner string 110 may further include a sealing device 130 (also referred to as "seal sub") that may include a sealing element 132, such as an expandable and retractable packer, configured to provide a fluid seal between the inner string 110 and the outer string 150 when the sealing element 132 is activated to be in an expanded state. Additionally, the inner string 110 may include a liner drive sub 136 that includes latching elements 136*a* and 136*b* that may be removably connected to any of the landing locations in the outer string 150 as described in more detail in reference to FIGS. 2-5. The inner string 110 may further include a hanger activation device or sub 138 having seal members 138*a* and 138*b* configured to activate a rotatable hanger 170 in the outer string 150. The inner string may include a third power generation device 140*b*, such as a turbine-driven device, operated by the fluid 107 flowing through the inner sting 110 configured to generate electric power, and a second two-way telemetry device 140*a* utilizing any suitable communication technique, including, but not limited to, mud pulse, acoustic, electromagnetic and wired pipe telemetry. The inner string 110 may further include a fourth power generation device 141, independent from the presence of power generation source using drilling fluid 107, such as batteries. The inner string 110 may further include pup joints 144 and a burst sub 146.

Still referring to FIG. 1, the outer string 150 includes a liner 180 that may house or contain a reamer bit 151 at its lower end thereof. The reamer bit 151 is configured to enlarge a leftover portion of hole 192*a* made by the pilot bit 102 as described later in reference to FIG. 2. In aspects, attaching the inner string at the lower landing 152 enables the inner string 110 to drill the pilot hole 192*a* and the under reamer 112 to enlarge it to the borehole of size 192 that is at least as large as the outer string 150. Attaching the inner string 110 at the middle landing 154 enables the reamer 151 to enlarge the section of the hole 192*a* not enlarged by the under reamer 112 (also referred to herein as the "leftover hole" or the "remaining pilot hole"). Attaching the inner string at the upper landing 156, enables cementing the annulus 187 between the liner 180 and the formation 195 without pulling the inner string 110 to the surface, i.e., in a single trip of the string 100 downhole. The lower landing 152 includes a female spline 152*a* and a collet grove 152*b* for attaching to the attachment elements 136*a* and 136*b* of the liner drive sub 136. Similarly, the middle landing 154 includes a female spline 154*a* and a collet groove 154*b* and the upper landing 156 includes a female spline 156*a* and a collet groove 156*b*. Any other suitable latching mechanism for connecting the inner string 110 to the outer string 150 may be utilized for the purpose of this disclosure.

The outer string 150 may further include a flow control device 162, such as a flapper valve, placed on the inside 150*a* of the outer string 150 proximate to its lower end 153. In FIG. 1, the flow control device 162 is in a deactivated or open position. In such a position, the flow control device 162 allows fluid communication between the wellbore 192 and the inside 150*a* of the outer string 150. In one aspect, the flow control device 162 may be activated (i.e. closed) when the pilot bit 102 is retrieved inside the outer string 150 to prevent fluid communication from the wellbore 192 to the inside 150*a* of the outer string 150. The flow control device 162 is deactivated (i.e. opened) when the pilot bit 102 is extended outside the outer string 150, as described in more detail in reference to FIG. 4. In one aspect, the force application members 105 or another suitable device may be configured to activate the flow control device 162. A reverse flow control device 166, such as a reverse flapper valve, also may be provided to prevent fluid communication from the inside of the outer string 150 to locations below the reverse flapper valve 166. The outer string 150 also includes a hanger 170 that may be activated by the hanger activation sub 138 to anchor the outer string 150 to the host casing 190. The host casing is deployed in the wellbore prior to drilling the wellbore 192 with the string 100. In one aspect, the outer string 150 includes a sealing device 185 to provide a seal between the outer string 150 and the host casing 190. The outer string 150 further includes a receptacle 184 at its upper end that may include a protection sleeve 181 having a female spline 182*a* and a collet groove 182*b*. A debris barrier 183 may also be provided to prevent cuttings made by the drill bit 102, under reamer 112 and the reamer bit 151 from entering the space or annulus between the inner string 110 and the outer string 150. A manner of drilling a wellbore, placing a liner in the wellbore and cementing the wellbore is described below in reference to FIGS. 1-5.

To drill the wellbore 192, the inner string 110 is placed inside the outer string 150 and attached to the outer string 150 at the lower landing 152 by activating the latching devices 136*a* and 136*b* of the liner drive sub 136 as shown in FIG. 1. This latching device 136, when activated, connects the latching elements 136*a* to the female splines 152*a* and the latching elements 136*b* to the collet groove 152*b* in the lower landing 152. In this configuration, the pilot bit 102 and the under reamer 112 extend past the reamer bit 151. In operation, the drilling fluid 107 powers the drilling motor 108 that rotates the pilot bit 102 to cause it to drill the pilot hole 192*a* while the under reamer 112 enlarges the pilot hole to the borehole 192. The pilot bit 102 and the under reamer 112 may also be rotated by rotating the drill string 100, in addition to rotating them by the motor 108.

Figure 2:
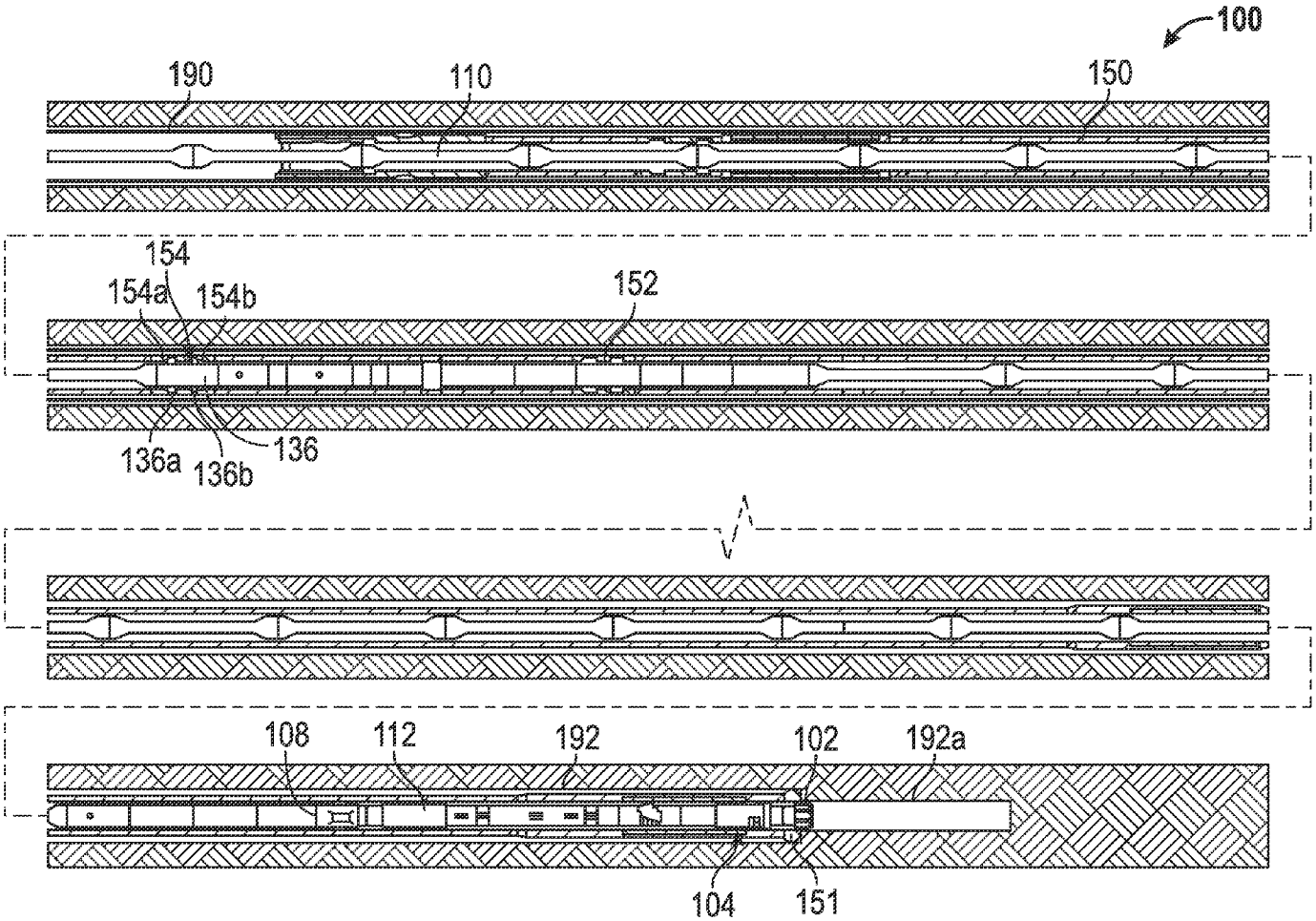
FIG. 2 shows the drill string of FIG. 1, wherein the inner string is retracted into the outer string and attached to the outer string at a second location for reaming the hole of the first size to form the wellbore.

Referring now to FIG. 2, after the bore 192*a* has been drilled by the pilot bit 102 and enlarged by the under reamer 112 to a desired depth, the drilling motor 108 and the rotation of the drill string 100 are stopped. The inner string 110 is then detached from the outer string 150 at the lower landing 152. The inner string 110 is pulled uphole and connected to the outer string 150 at the middle landing 154 by activating the liner drive sub 136, which causes the connection members 136*a* and 136*b* to engage the female spline 154*a* and collet groove 154*b* of the middle landing 154. In this configuration, the pilot bit 102 is positioned slightly below or downhole of the reamer bit 151, as shown in FIG. 2. The drill string 100 shown in FIG. 2 is then rotated to ream or enlarge the leftover borehole 192*a* by the reamer bit 151. If desired, the wellbore 192 may be drilled beyond the initial depth of the pilot hole by rotating the drill string 100, which will rotate both the pilot bit 102 in addition to the motor and the reamer bit 151. In such a configuration, the steering device 104 being inside the outer string 150 cannot be activated to steer the drill string 100. For clarity, the liner 190 installed in the prior installation is shown placed in the wellbore overlapping a portion of the string 100.

Figure 3:
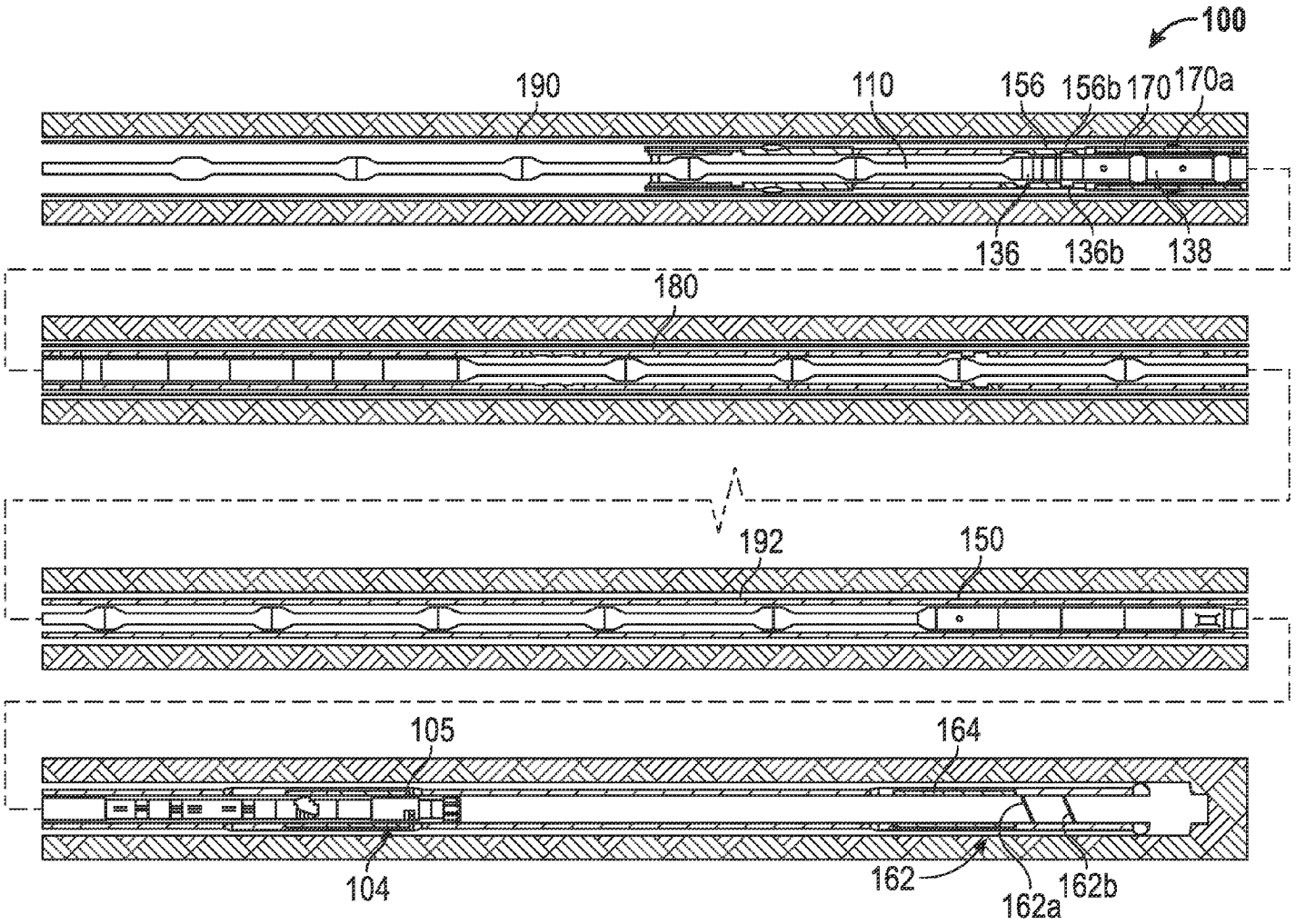
FIG. 3 shows the drill string of FIG. 1, wherein the inner string has been pulled uphole and connected to a third location in the outer string and wherein a first flapper valve has been activated and a liner hanger on the outer string has been activated to attach it the wellbore.

FIG. 3 shows a configuration of the string 100 for setting the liner 180 in the wellbore 192. To set the liner 180, the inner string 110 is pulled uphole to cause the steering members 105 of the steering device 104 to move the protection sleeve 164 of the lower flapper valve 162 uphole. The flapper valve 162 is shown to include a primary flapper 162*a* and a secondary redundant flapper 162*b*. The flapper valve 162, once activated (as shown in FIG. 3), prevents the flow of fluids from the wellbore 192 back into the outer string 150. The steering members 105 are then deactivated or retracted and the inner string 110 pulled back to connect it to the upper landing 156 as shown in FIG. 3. To connect the inner string to the upper landing 156, the liner drive sub 136 is activated to cause the connection members 136*b* to engage the collet groove 156*b* of the upper landing 156. The hanger activation sub 138 is activated to activate the liner hanger 170 to cause the anchor 170*a* of the liner hanger 170 to attach to the host liner 190. Such a configuration of the liner hanger 170 enables the outer string 150 to be rotated even though it is attached to the host casing 190. It should be noted that in the method described herein, the host liner 190 has already been installed and therefore the outside dimensions of the outer string 150 are less than the inner dimensions of the prior installed host liner 190.

Figure 4:
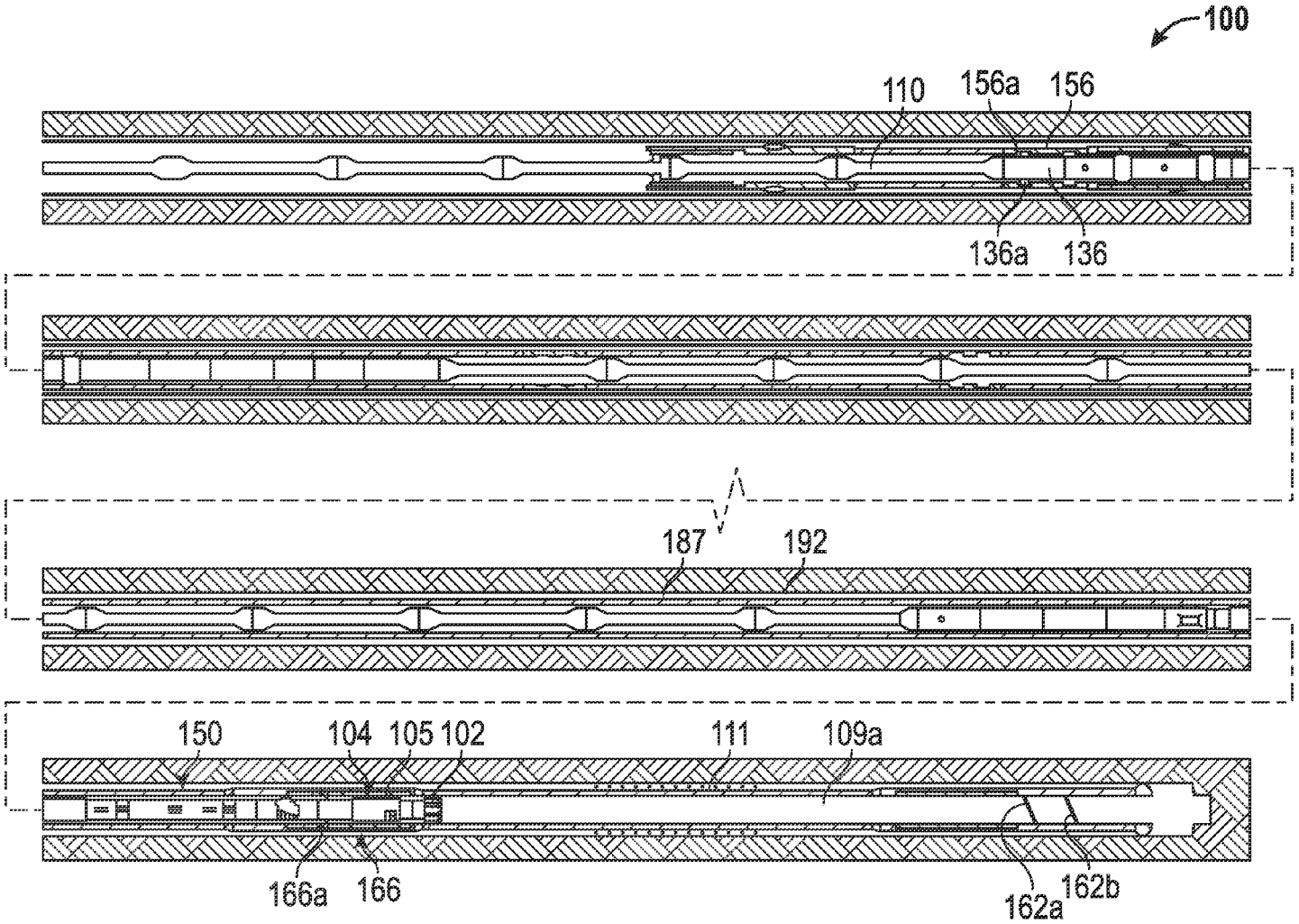
FIG. 4 shows the drill string of FIG. 1, wherein the inner string is locked with the outer string so that rotating the inner string will cause the outer string to rotate during cementing.

FIG. 4 shows the string 100 ready for cementing. Prior to cementing, the inner string 110 is pulled uphole to lock the connection members 136*a* of the liner drive sub 136 into the female spline 156*a* of the upper landing 156. In this position, rotating the inner string 110 causes the outer string to rotate. Pulling the inner string 110 up to the spline 156*a* also causes the steering members 105 of the steering device 104 to activate the upper reverse flapper 166 by causing the members 166*a* to drop inside the outer string 150. At this stage, the string 100 is ready for cementing. To cement the annulus 187 between the outer string 150 and the wellbore 192, an amount of cement 111 is pumped from the surface into the inner string 110. The cement 111 discharges from the drill bit bottom and fills the annulus 187 and the space 109*a* below the pilot bit 102. Flappers 162*a* and 162*b* allow one way flow of the cement 111 and thus the pumped cement cannot return back into the outer string 150. The string 100 may be rotated during the cementing process for even distribution of the cement 111 in the annular space 187. The attachments between the inner string and the outer string are configured so that they provide sufficient torque so that rotating the inner string from surface causes the outer string to rotate while cementing.

Figure 5:
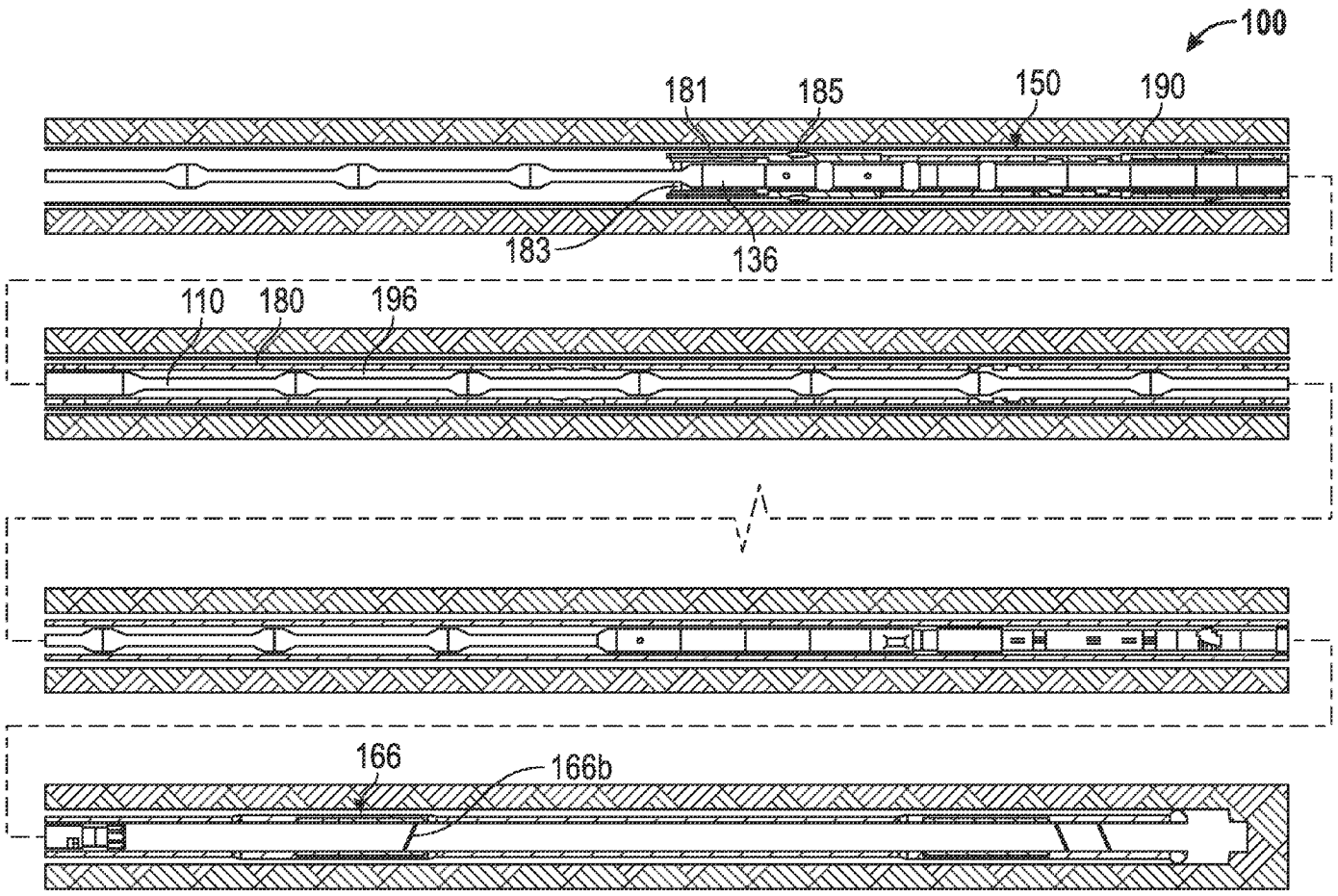
FIG. 5 shows the drill string of FIG. 1, wherein the inner string has been pulled uphole and attached to a fourth location in the outer string and a second flapper valve has been activated so that the inner string may be pulled to the surface.

Referring now to FIG. 5, once the cementing process is completed, the inner string 110 is pulled uphole to cause the liner drive sub 136 to latch onto the protection sleeve 181. The packer 185 is activated to provide a seal between the outer liner 180 and the previously installed liner 190. Pulling the inner string 110 also causes the flapper 166*b* of the reverse flapper 166 to deploy, which prevents fluid from flowing from the inner string 110 past the flapper 166*b*. This allows any fluid supplied to the inner string 110 to circulate in the space 196 between the inner string 110 and the outer string 150. The debris barrier 183 prevents debris from entering into the space 196 between the inner string 110 and the outer string 150 from uphole. Once the packer 185 has been set, the inner string 110 is pulled out of the hole, retrieving the protection sleeve 181 to the surface, thereby drilling a wellbore, lining the wellbore and cementing the wellbore by a drill string carrying a liner during a single trip.

Thus, in one aspect, the drill string 100 may be utilized to drill a wellbore, log the wellbore, install a liner in the wellbore and cement the annulus between the liner and the wellbore during a single trip of a drill string into the wellbore, i.e., without retrieving the drill string from the wellbore. It should be noted that the drill string embodiment shown in FIG. 1 is an exemplary configuration. The drill string may be configured in any number of alternative manners. For example, the drill string 100 may be configured to include two or more landings. In other configurations, the under reamer may or may not be utilized. In some configurations, the under reamer may be activated or deactivated on demand, such as by transmitting a command signal from the surface to the controller in the drill string. In some configurations, the liner may or may not contain the under reamer. The flapper valve may be activated by any suitable device, including the steering device. Before pumping the cement, the rotatable liner hanger may be hydraulically activated by a hanger activation sub inside the inner string or another mechanism. The connection of the inner string and the liner string may be activated by a liner drive sub in response to a down-link signal supplied from the surface. The liner sub also may provide the transmission of torque and axial forces.

While the foregoing disclosure is directed to the preferred embodiments of the disclosure, various modifications will be apparent to those skilled in the art. It is intended that all variations within the scope and spirit of the appended claims be embraced by the foregoing disclosure.

The invention claimed is:

1. A method of forming a wellbore, comprising:

providing a drill string having an outer string that includes a plurality of axially-spaced apart landing locations and an inner string configured to attach to the outer string at each of the plurality of landing locations;

attaching the inner string to a first landing location of the outer string, and forming the wellbore with the inner string of a first size and enlarging a first portion of the wellbore of the first size to a second size that is at least as large as the outer string;

detaching the inner string from the first landing location;

attaching the inner string at a second landing location of the outer string; and enlarging a second portion of the wellbore of the first size to at least the size of the outer string with the inner string attached at the second landing location.

2. The method of claim 1 further comprising detaching the inner string form the second landing location, attaching the inner string to the outer string at a third landing location and cementing an annulus between the outer string and the wellbore.

3. The method of claim 2 further comprising activating a flow control device in the outer string configured to prevent flow of a fluid from the outer string to the wellbore.

4. The method of claim 3 further comprising using a device in the inner string to activate the flow control device.

5. The method of claim 2 further comprising rotating the outer string while cementing, wherein torque is supplied via the attachment of the inner string to the outer string.

6. The method of claim 2 further comprising retrieving the inner string from the outer string, thereby forming the wellbore, placing the outer string in the wellbore and cementing the annulus between the outer string and the wellbore during a single trip of the drill string in the wellbore.

7. The method of claim 1 further comprising activating a flow control device in the outer string configured to prevent flow of a fluid from the wellbore into the outer string.

8. The method of claim 7 further comprising using a device in the inner string to activate the flow control device.

9. The method of claim 1 further comprising sealing an annulus between the inner and the outer string at a selected location of the outer string.

10. The method of claim 1 further comprising anchoring the outer string to a prior installed tubular or the wellbore before or after cementing the annulus.

11. The method of claim 1 further comprising sealing an annulus between the outer string and a prior installed tubular or the wellbore at a selected location of the outer string.

12. The method of claim 1 further comprising obtaining measurements while forming the wellbore using one or more sensors.

13. A method of forming a wellbore, comprising:

providing an inner string and an outer string;

attaching the inner string to the outer string at a first location of the outer string and forming the wellbore;

detaching the inner string from the first location of the outer string;

attaching the inner string to the outer string at a second location of the outer string uphole of the first location; and cementing an annulus between the outer string and the wellbore with the inner string attached at the second location, without retrieving the inner string from the wellbore.

14. An apparatus for forming a wellbore, comprising:

an outer string including a plurality of axially-spaced landing locations; and an inner string configured to:

(a) attach to a first landing location of the outer string for forming with the inner string the wellbore of a first size and enlarging a first portion of the wellbore of the first size to a second size that is at least as large as the outer string;

(b) detach from the first landing location of the outer string and move to a second landing location of the outer string uphole of the first landing location; and (c) attach to the second landing location for enlarging a second portion of the wellbore of the first size to at least the size of the outer string.

15. The apparatus of claim 14 further comprising a hole-opening device in the inner string configured to enlarge at least a portion of the wellbore of the first size to a second size larger than the outer string.

16. The apparatus of claim 14 further comprising a flow control device in the outer string configured to prevent flow of a fluid from the wellbore into the outer string when activated.

17. The apparatus of claim 16 further comprising a device in the inner string configured to activate the flow control device.

18. The apparatus of claim 14, wherein the inner string is further configured to be attached to the second landing or a third landing in the outer string to enable cementing of an annulus between the outer string and the wellbore.

19. The apparatus of claim 18 further comprising a flow control device in the outer string configured to prevent flow of a fluid from the outer string to the wellbore when activated.

20. The apparatus of claim 19 further comprising a device in the inner string configured to activate the flow control device.

21. The apparatus of claim 14 further comprising a device allowing sealing of an annulus between the inner and the outer string at a selected location of the outer string.

22. The apparatus of claim 14 further comprising a device configured to anchor the outer string to a prior installed tubular or in the wellbore before or after cementing.

23. The apparatus of claim 14 further comprising a device that enables sealing of an annulus between the outer string and a prior installed tubular or the wellbore at a selected location of the outer string.

24. The apparatus of claim 14, wherein attaching the inner string to the outer string provides sufficient torque to allow rotating of the outer string while cementing.

25. The apparatus of claim 14 further comprising one or more sensors configured to obtain measurements relating to a formation surrounding the wellbore during forming of the wellbore.

26. The apparatus of claim 14, wherein attaching the inner string at the first landing location and then at the second landing location enables forming of the wellbore, placing a liner in the wellbore and cementing the wellbore during a single trip of the inner string in the wellbore.

* * * * *